United States Patent [19]

Bedall et al.

[11] 4,129,061

[45] Dec. 12, 197

[54] FRAGMENTATION CASING FOR SHELLS, WARHEADS AND THE LIKE AND METHOD OF MAKING SAME

[75] Inventors: Hans Bedall, Nüremberg; Max Rentzsch, Rothenbach, both of Fed. Rep. of Germany

[73] Assignee: DIEHL, Nuremberg, Fed. Rep. of Germany

[21] Appl. No.: 780,480

[22] Filed: Mar. 23, 1977

[30] Foreign Application Priority Data

Mar. 23, 1976 [DE] Fed. Rep. of Germany ..... 2612149
Jul. 31, 1976 [DE] Fed. Rep. of Germany ..... 2634570

[51] Int. Cl.[2] ..... F42B 13/18; F42B 13/48

[52] U.S. Cl. ..... 86/20 B; 102/67; 29/1.21; 29/1.23

[58] Field of Search ..... 29/1.2, 1.21, 1.23; 102/64, 67; 86/20 B

[56] References Cited

U.S. PATENT DOCUMENTS 3,026,804 3/1962 Adler ..... 102/67
4,032,335 6/1977 Zapf et al. ..... 102/67

FOREIGN PATENT DOCUMENTS 177024 8/1905 Fed. Rep. of Germany ..... 102/67
1943472 3/1971 Fed. Rep. of Germany ..... 102/6

*Primary Examiner*—Verlin R. Pendegrass
*Attorney, Agent, or Firm*—Walter Becker

[57] ABSTRACT

A fragmentation casing for shells, warheads and th like, in which pre-shaped fragmentations or splinters c hard or hardenable material are embedded in a suppor ing structure which is formed by a material that su rounds the fragmentations on all sides. This material i adapted in response to the ignition of an explosiv charge provided in the fragmentation casing to disinte grate into individual particles to thereby release th pre-shaped fragmentations or splinters. The fragmenta tion casing includes a shell base body which within th region of a sleeve-shaped portion intermediate the rea portion and the head portion of the shell base body i provided with an outer recess which is cylindrical a least over a portion of the shell. Placed in this recess a a single layer are pre-formed fragmentations, primaril heavy metal balls, together with a material which hardenable by sintering. These fragmentations placed i the recess are pressed into a supporting structure su rounding the fragmentations. The fragmentations ar pressed into and sintered in a sleeve-shaped fragmenta tion mantle.

5 Claims, 6 Drawing Figures

FRAGMENTATION CASING FOR SHELLS, WARHEADS AND THE LIKE AND METHOD OF MAKING SAME

The present invention relates to a fragmentation casing for shells, warheads (Gefechtsköpfe) and the like, according to which pre-formed splinters of hard or hardenable material are embedded in a supporting structure of a material which is hardenable by sintering and which surrounds the splinters on all sides, said material being adapted in response to the ignition of an explosive in said fragmentation casing to disintegrate while freeing the pre-formed splinters as individual particles. The invention also concerns a method of making such fragmentation casing.

According to the Austrian Pat. No. 236 256, it has become known to envelop pre-formed splinters in a form and to connect the same by an added adhesive so as to form a coarse pore body. Furthermore, German Offenlegungsschrift No. 1 943 472 discloses a fragmentation warhead with pre-formed splinters, in which the pre-formed splinters are by means of sintering combined to form a supporting structure member which forms the mantle for the warhead or at least parts thereof. Between the splinters, free spaces are supposed to remain which, if desired, are filled in with a specifically lighter material such as aluminum or synthetic material.

Finally, it has also become known to embed pre-formed splinters in a structure of concrete or another hardenable or self-hardening material. Austrian Pat. No. 26 846 also discloses the idea with a shell to fill in ball splinters between two concentrically arranged tubular bodies. A splinter body of a particular type is disclosed in German Offenlegungsschrift No. 21 29 196 according to which primarily as a single layer, ball splinters fill in between two pipes or tubular bodies and are enclosed by high pressure deformation. In this connection, the inner tubular body is by radial deformation pressed into hollow spaces between the splinters and while a pre-fragmentation of the two tubular bodies is effected, said inner tubular body is plated or laminated together with the outer tubular body to form a rotation-symmetric fragmentation casing.

German Offenlegungsschrift No. 20 01 754 discloses a fragmentation shell with pre-formed fragmentation material arranged between two sleeves while within the inner sleeve there is provided brisant explosive. The inner sleeve represents a one-piece portion of the shell body and when firing the shell transfers at least a portion of the axial shearing forces, whereas the outer sleeve in addition to the axial forces also absorbs the centrifugal forces of the fragmentation material as they are created by the rotation of the shell.

The first mentioned shell casings have in part a high ballast component which is practically ineffective in battle and in part during the disintegration of the fragmentation mantle form clumps. With other above mentioned fragmentation casings, a considerable portion of the output of the explosive is used up for the disintegration of the disintegration casing instead of being used for the acceleration of the fragmentation or splinter elements. Furthermore, in many cases, disintegration forces become accidentally effective as structure transforming forces which means that the pre-formed splinters and/or the supporting structure therefor are diminuted into particles or are ground down into particles which are then ineffective for the purposes for which the fragmentation casings were intended.

It is, therefore, an object of the present invention to provide a fragmentation casing which as shell body or warhead will possess the required axial and rotation stability and will be able without great loss of energy to disintegrate in as many as possible uniform splinters of a predetermined size but when the fragmentation casing is sintered and subsequently cooled, will neither detach from the shell body nor toward the latter or therein form tears or gaps which could interfere with the uniform disintegration and splinter effect.

These and other objects and advantages of the invention will appear more clearly from the following specification in connection with the accompanying drawings, in which.

Figure 1:
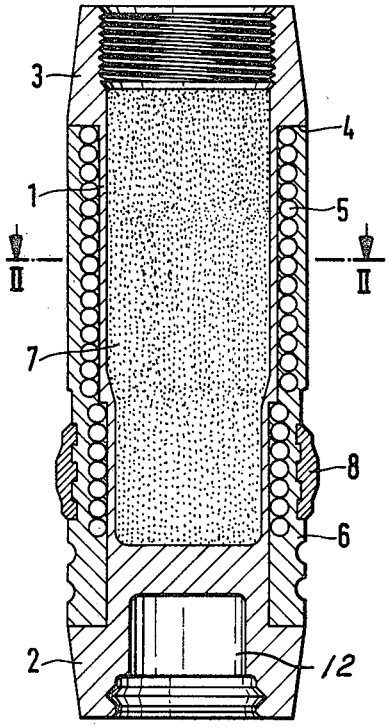
FIG. 1 represents a longitudinal section through a shell body with a fragmentation casing according to the invention, said section being taken along the line I—I of FIG. 2.
Figure 2:
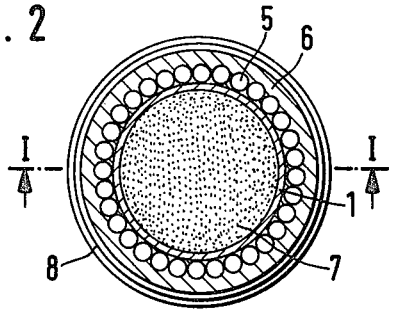
FIG. 2 represents a cross section through the shell body and its fragmentation sleeve, said section being taken along the line II—II of FIG. 1.

The fragmentation casing according to the present invention is characterized primarily in that a shell base body within the region of a sleeve-shaped intermediate part located between a shell rear portion and a head portion is provided with an outer cylindrical recess extending over at least a portion of the shell while into said recess there are introduced as a single layer the pre-formed splinters, preferably in the form of heavy metal balls, together with a material which is hardenable by sintering. Said pre-formed splinters are compressed to form a sleeve-shaped splinter mantle which receives the splinters in an enveloping supporting structure and supported radially and axially in said recess, said splinters being centered into said sleeve-shaped splinter mantle.

The manufacture of the fragmentation casing or a shell body provided with such fragmentation casing is according to a further feature of the invention carried out by first turning ing a raw body corresponding coarsely to the shell body and consisting of solid material, only on the outside and more specifically over its intermediate portion which is intended for receiving the fragmentation sleeve, so as to meet the rated measurement, and only after the sinter material of the sinter mantle has been applied, the unfinished shell body is machined to its rated measurement and is provided with inner bores for receiving the explosive as well as a tracer composition if the latter is to be desired. Inasmuch as the inserted pre-formed splinters, preferably lls, in axial direction of the shell body are located osely to each other, it will be appreciated that during e sintering operation and the subsequent cooling off of e sintered splinter casing, there will not occur any gap tear formation since the change in length of the splin- r mantle does not materially vary from the shrinking length of the shell body. However, in radial direction, ıring the cooling-off of the shell body, there will be ıused an even stronger embracing of the sleeve-shaped ntral portion of the shell body because the sintered agmentation mantle will during the cooling-off period ntract to a greater extent than the shell base body.

Inasmuch as the covering of the base body with the linters and the sinter mantle occurs primarily as long the raw shell has not been drilled along its axis, even hen pressing on the splinter layer or splinter mantle sing during which operation radial pressures of sev- al thousand kp/cm$^2$ are required, no deformations of e base body occur. During the sintering operation, in ew of the full core, already in the heating-up phase, a tter, which means more uniform temperature distri- ıtion is obtained and thus a covering of the base body hich is nearly free from tension and expansion forces.

Referring now to the drawings in detail, the shell base ody shown therein comprises a sleeve-shaped central ortion 1 which is located between a thicker shell rear ortion 2 and a head portion 3, and which has a radial cess 4 extending around the shell body. This recess 4 at its front portion about cylindrical. The sleeve- aped central portion 1 of the shell base body has over e cylindrical front portion a somewhat shorter outer ameter.

Pre-shaped splinters or fragmentation bodies 5, pref- ably of hard metal or hardened or hardenable steel, pecially heavy metal ball splinters are located in said cess 4 and are mounted in a supporting structure 6 of nter metal powder. The sintering operation of the etal powder for instance light metal or steel powder referably represents at the same time an operational ep of hardening the splinters 5. The sintering opera- on itself is effected in a well-known manner which eans in any convenient known manner. The splinter r fragmentation bodies 5 with their sinter supporting ructure 6 form a concentric annular mantle which in iew of the somewhat greater shrinking of the sinter aterial over the material of the shell base body will uring the cooling-off operation closely and non-dis- laceably engage the sleeve-shaped central portion 1 of e shell base body, which means that a sleeve-shaped ylinder mantle is formed which axially and in a radial abile manner will embrace the shell base body. In the terior, and more specifically in about the region of the agmentation mantle 5, 6 the shell base body is filled ith explosive 7. Within the region of the narrower part f the sleeve-shaped central portion 1 of the shell base ody or the radial thicker area of the supporting struc- ure 6, the fragmentation mantle 5, 6 is provided with a hell guiding ring 8 which is in a manner known per se ressed into radial recesses of the supporting structure 6 f the fragmentation mantle 5, 6.

The manufacture of a fragmentation mantle-shell of he above mentioned type is preferably effected in the anner illustrated in FIGS. 3–6. First, on a turning utomat, a raw body is prepared from a solid rod in onformity with FIG. 3, so that the raw shell body, vithin the region between its head portion 3' and its ear portion 2' has a central portion 1' which has been urned to rated dimensions. The rear portion 2' is in customary manner provided with a centering bore 10. After cutting off the raw body 1', 2', 3', also the head portion 3' and its end face provided with a centering bore 9. Of course, instead thereof also a chucking extension or the like could be provided. As will be seen from FIG. 3, head and rear portions 3', 2' respectively have radially as well as axially a raw over-dimension and are only in a later working operation machined to the rated dimensions.

Figure 5:
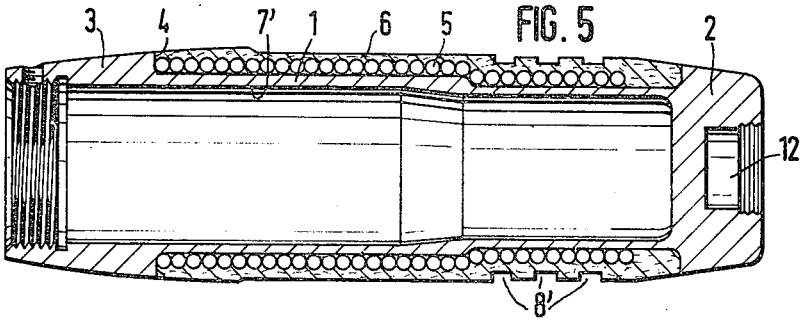
FIG. 5 represents a longitudinal section through the unfinished shell body which has its outside post turned to the rated measurement while the inner shell body has been bored over the shape of FIGS. 3 and 4 of the shell.

FIG. 5 shows the raw shell body 1'–3' after the one-layer covering with the pre-formed splinters 5 has been effected which splinters at the end phase engage a shoulder 4 of the head portion 3' and embrace the raw body with its central portion 1' in a tubular manner. This splinter cover 5 is enclosed by a supporting structure 6' of sinter metal powder which is pressed on under high pressure in any convenient manner and then is sintered together with the raw body 2', 1', 3' and splinters 5 to form a firm structure.

After the sintering operation and a for instance following tempering operation has been effected, the hollow in the shell body will then be prepared. To this end, in conformity with FIG. 5, the raw body is machined to its rated dimensions during which not only the head portion 3 and the rear portion 2 of the shell body obtain their later shape but also the sinter casing 6 is shaped in conformity with the caliber of the shell and at the same time is provided with an annular groove 8' for a guiding band 8 (FIG. 6) which is rolled into the wall of the sinter casing 6 in a later working step. If desired, the rear portion 2 is provided with a recess 12 for a tracer composition or with a recess 13 for a bottom plate 11 likewise shown in FIG. 6. Subsequently to the outer machining just set forth, the shell body is drilled which means is provided with a bore 7' which later receives the explosive charge 7. The two working operations — the turning of the outer surface and the drilling — could, of course, be carried out in the reverse order which means the drilling first and the outer machining thereafter.

Figure 3:
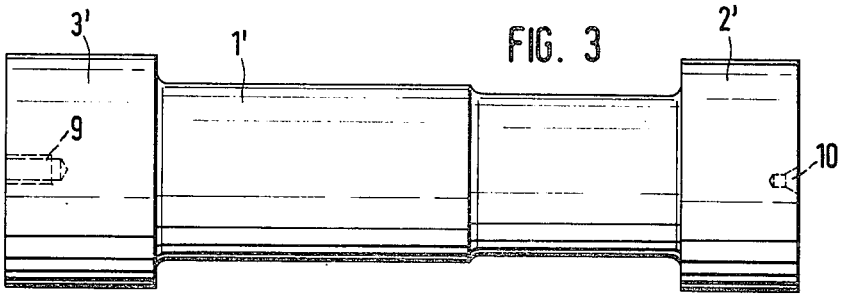
FIG. 3 is a side view of a unfinished shell body as cut off from a solid bar and having its central portion turned in conformity with the rated measurement.
Figure 4:
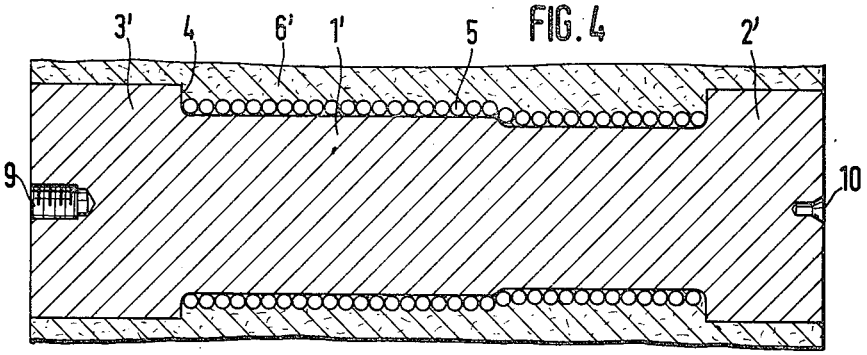
FIG. 4 is a longitudinal section of the unfinished shell body covered with fragmentation bodies and provided with a sinter mantle after the sinter operation has been carried out in conformity with FIG. 3.
Figure 6:
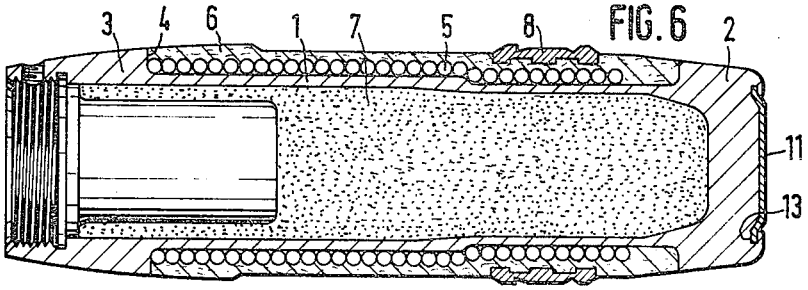
FIG. 6 shows a longitudinal section of the finished machined explosive filled shell body which has been produced in conformity with the steps illustrated in FIGS. 3–5 and has been provided with a bottom plate at its rear end while the fuse is missing.

After the machining, as illustrated in FIGS. 3–5 of the shell body, has been completed, the guiding band 8 is applied and the tracing composition is pressed in or as shown in FIG. 6, a disc-shaped bottom plate 11 is inserted for instance, is hot soldered thereto, welded thereto, or is connected to the rear portion of the shell in any convenient manner, for instance by folding the rim of the disc into the cavity 13. The shell can then in customary manner be filled with an explosive 7 and be equipped with a fuse.

It is, of course, to be understood that the invention is, by no means, limited to the specific showing in the drawings, but also comprises any modifications within the scope of the appended claims.

What we claim is:

1. A method of making a fragmentation casing for projectiles, especially shells and warheads, which includes the steps of: providing a solid raw body having a base body with ends as well as a front section and a rear section each having end faces and an intermediate section including an outside therebetween, machining to rated dimensions only the outside of said intermediate section, applying to said machined intermediate section a layer of fragmentations and hardenable sinter material, sintering and pressing said fragmentations and sinter material into said machined intermediate section, and after hardening of said sinter material, machining over the outside thereof to the rated dimensions, providing an axial bore in the thus machined body, and placing an explosive charge in said bore.

2. A method according to claim 1, which includes the steps of providing the rear section of said base body with a bore, and placing a tracer substance in said last mentioned bore.

3. A method according to claim 1, which includes the step of prior to machining the outside of said intermediate section providing the two end faces of said base body with centering bores.

4. A method according to claim 1, which includes the step of prior to machining the outside of said intermediate section providing at least one of the ends of said base body with a chucking extension.

5. A method according to claim 1, which includes the step of providing the end face of said rear section with recess means, and preparing a bottom plate and inserting same in said recess means.

* * * * *